US005210067A

United States Patent [19]

Egashira et al.

[11] Patent Number: 5,210,067

[45] Date of Patent: May 11, 1993

[54] HEAT TRANSFER-RECEIVING SHEETS

[75] Inventors: Noritaka Egashira; Osamu Shimizu, both of Tokyo, Japan

[73] Assignee: Dai Nippon Insatsu Kabushiki Kaisha, Japan

[21] Appl. No.: 651,416

[22] PCT Filed: Jun. 14, 1990

[86] PCT No.: PCT/JP90/00779

§ 371 Date: Feb. 11, 1991

§ 102(e) Date: Feb. 11, 1991

[87] PCT Pub. No.: WO90/15720

PCT Pub. Date: Dec. 27, 1990

[30] Foreign Application Priority Data

Jun. 16, 1989 [JP] Japan ..... 1-152300
Aug. 29, 1989 [JP] Japan ..... 1-222633

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,855,281 8/1989 Byers ..... 503/227
5,013,711 5/1991 Egashira et al. ..... 503/227

FOREIGN PATENT DOCUMENTS 61-58791 3/1986 Japan ..... 503/227
1-127387 5/1989 Japan ..... 503/227

*Primary Examiner*—B. Hamilton Hess
*Attorney, Agent, or Firm*—Parkhurst, Wendel & Rossi

[57] ABSTRACT

A heat transfer image-receiving sheet including a substrate sheet and a dye-receiving layer formed on one surface of the substrate sheet. The dye-receiving layer is composed of a resin containing an antioxidant expressed by the following structural formula (I) or (II):

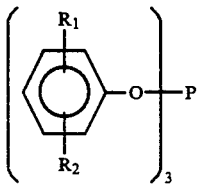

(I)

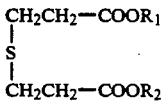

(II)

wherein $R_1$ and $R_2$ each represent a hydrogen atom or a substituted or unsubstituted alkyl group.

12 Claims, No Drawings

HEAT TRANSFER-RECEIVING SHEETS

TECHNICAL FIELD

The present invention relates to a heat transfer image-receiving sheet and, more particularly, to a heat transfer image-receiving sheet capable of making image representations excelling in various fastness properties, especially light fastness.

BACKGROUND TECHNIQUE

Among various heat transfer techniques so far known in the art, there is proposed a sublimation type of transfer system wherein a sublimable dye as a recording material is carried on a substrate sheet such as paper or a plastic film to make a heat transfer sheet, which is in turn overlaid on a heat transfer sheet dyeable with a sublimable dye, for instance, a heat transfer sheet comprising paper or a plastic film having a dye-receiving layer on its surface to make various full-color images thereon. In this system, the thermal head of a printer is used as heating means to transfer three-, four- or more-color dots by a very quick heating, thereby reconstructing a full-color image of the original by the multi-color dots.

Because the coloring material used is a dye, the thus formed image is so clear and so excellent in transparency that the resulting image representation can be improved in the reproducibility of halftone and gray scale. This makes it possible to form image representations similar to those achieved with conventional offset or gravure printing and comparable in quality to full-color photographic images.

A problem with the thus obtained image representations, however, is that because of being formed of a dye, they are generally so inferior in light fastness to pigmented images upon being exposed directly to sunlight, they fade or discolor prematurely. Some solution to such a light fastness problem may be provided by adding ultraviolet absorbers or antioxidants to the dye-receiving layers of heat transfer image-receiving sheets. Yet image storability presents an important problem to be solved.

DISCLOSURE OF THE INVENTION

It is, therefore, an object of this invention to provide a heat transfer image-receiving sheet designed to be used with heat transfer systems making use of sublimable dyes to make clearer image representations which are of sufficient density and show more improved fastness properties, especially more improved light fastness.

The above-mentioned object is achieved by the present invention to be hereinafter described.

More specifically, one aspect of this invention relates to a heat transfer image-receiving sheet comprising a substrate sheet and a dye-receiving layer formed on at least one surface of the substrate sheet, characterized in that the dye-receiving layer is composed of a resin containing an antioxidant expressed by the following structural formula (I).

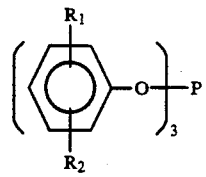

(I)

wherein $R_1$ and $R_2$ each represent a hydrogen atom or a substituted or unsubstituted alkyl group.

According to another aspect of this invention, there is provided a heat transfer image-receiving sheet comprising a substrate sheet and a dye-receiving layer formed on at least one surface of said substrate sheet, characterized in that the dye-receiving sheet is composed of a dye containing an antioxidant expressed by the following structural formula (II):

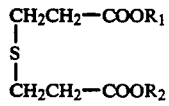

(II)

wherein $R_1$ and $R_2$ each represent a substituted or unsubstituted alkyl group.

By allowing each of the aforesaid specific antioxidants to be contained in a dye-receiving layer, it is possible to provide a heat transfer image-receiving sheet which, when used with heat transfer systems making use of sublimable dyes, forms clearer image representations of sufficient den and showing more improved fastness properties, especially more improved light fastness.

BEST MODE FOR CARRYING OUT THE INVENTION

The present invention will now be explained in greater detail with reference to some preferred embodiments.

The heat transfer image-receiving sheet according to this invention comprises a substrate sheet and a dye-receiving layer formed on at least one surface thereof.

No limitation is placed on substrate sheets used in this invention. For instance, use may be made of various types of papers such as synthetic paper (based on polyolefin, polystyrene, etc.), fine paper, art paper, coated paper, cast coated paper, wall paper, backing paper, synthetic resin or emulsion impregnated paper, synthetic rubber latex impregnated paper, synthetic resin intercalated paper, paper board and cellulose fiber paper; and various kinds of plastic films or sheets based on, e.g. polyolefin, polyvinyl chloride, polyethylene terephthalate, polystyrene, polymethacrylate and polycarbonate. Use may also be made of white, opaque films or foamed sheets obtained from such synthetic resins to which white pigments and fillers are added.

The aforesaid substrate sheets may be laminated together in any desired combination. Examples of typical laminates are combined cellulose fiber paper/synthetic paper and combined cellulose fiber paper/plastic films or sheets. The substrate sheet or sheets may have any desired thickness, for instance, a thickness of generally about 10 to 300 μm.

If the substrate film is poor in its adhesion to the dye-receiving layer to be formed on its surface, then it may preferably be primer- or corona discharge treated on that surface.

The dye-receiving layer according to this invention is formed on the surface of the substrate sheet to receive a sublimable dye coming from the associated heat transfer sheet and maintain the resultant image.

As the resins for forming the dye-receiving layer, for instance, use may be made of polyolefinic resins, e.g. polypropylene; halogenated polymers, e.g. polyvinyl chloride and polyvinylidene chloride; vinylic polymers, e.g. polyvinyl acetate and polyacrylic esters; polyester resins, e.g. polyethylene terephthalate and polybutylene terephthalate; polystyrene resins; polyamide resins; polyurethane resins; copolymeric resins, e.g. copolymers of olefins such as ethylene and propylene with other vinyl monomers; ionomers; cellulosic resins, e.g. cellulose diacetate; and polycarbonates. Particular preference, however, is given to the vinylic and polyester resins.

The heat transfer image-receiving sheet according to this invention may be obtained by coating at least one surface of the substrate sheet with a solution or dispersion of such a resin as mentioned above dissolved or dispersed together with the required additives in a suitable organic solvent or water by suitable means such as gravure printing, screen printing or reverse roller coating with a gravure and, then, drying and curing the coating to form a dye-receiving layer on that surface.

When forming the dye-receiving layer, pigments or fillers such as titanium oxide, zinc oxide, kaolin, clay, calcium carbonate and finely divided silica may be added thereto with a view to improving its whiteness, thereby making further improvements in the clearness of the transferred image.

According to the first aspect of this invention, the antioxidant represented by the following structural formula (I) is incorporated in the dye-receiving layer so as to enhance the light fastness of a transferred image formed thereon.

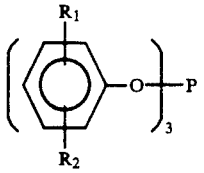

(I)

wherein $R_1$ and $R_2$ have the same meanings as defined above.

An antioxidant expressed by Formula (I) wherein $R_1$ is an alkyl group, e.g. $C_9H_{19}$—and $R_2$ is a hydrogen atom, for instance, is available under the name of Sumilizer TNP (made by Sumitomo Chemical Co., Ltd.), while an antioxidant wherein $R_1$ and $R_2$ are both hydrogen atoms, for instance, is available under the trade name of Sumilizer TPP-R (made by Sumitomo Chemical Co., Ltd.), both being usable in this invention. These antioxidants may be used alone or in admixture.

Where $R_1$ and/or $R_2$ are alkyl groups, they may have about 1–30, preferably 4–9 carbon atoms and may be either substituted or not.

According to the second aspect of this invention, the antioxidant represented by the following structural formula (II) is incorporated in the dye-receiving layer so as to enhance the light fastness of a transferred image formed thereon.

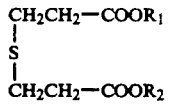

(II)

wherein $R_1$ and $R_2$ have the same meanings as defined above.

An antioxidant expressed by Formula (II) wherein $R_1$ and $R_2$ are both $C_{12}H_{25}$, for instance, is available under the trade name of Sumilizer TPL-R (made by Sumitomo Chemical Co., Ltd.), while an antioxidant wherein $R_1$ and $R_2$ are both $C_{18}H_{37}$, for instance, is available under the trade name of Sumitomo Chemical Co., Ltd.), both being usable in this invention. These antioxidants may be used alone or in admixture.

Preferably, $R_1$ and/or $R_2$ are a substituted or unsubstituted alkyl group having about 1–30, particularly about 12–18 carbon atoms.

Although not critical, such specific antioxidants as mentioned above may be used in an amount of 0.05–10, preferably 3–10 parts by weight per 100 parts by weight of the resin forming the dye-receiving layer. Too small an amount makes it difficult to attain the desired effect of this invention, whereas too large an amount incurs considerable expense.

According to this invention, the specific antioxidant may be used in addition to or in combination with a light stabilizer and/or an ultraviolet absorber so as to enable the light fastness of images to be significantly more improved than possible by sole use of the specific antioxidant. This is true even when the total amount of the antioxidant and such additives lies in the above-mentioned range.

Light stabilizers heretofore known in the art are all usable to this end. However, those expressed by the following structural formula are particularly preferred.

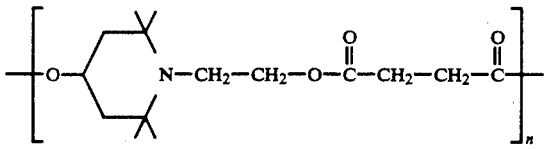

The above light stabilizers, for instance, are commercially available under the trade name of Tinuvin 622LD (made by Ciba Geigy AG).

Also, ultraviolet absorbers so far known in the art may all be used in combination with the antioxidant. However, those represented by the following structural formula are particularly preferred.

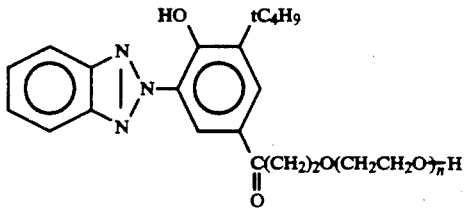

wherein n is an integer equal to or larger than 6.

The above UV absorbers, for instance, are commercially available under the trade name of Tinuvin 1130 (made by Ciba Geigy AG).

Although not critical, the light stabilizer and/or the UV absorber should preferably be used in an amount of 0.05 to 10, preferably 3–10 parts by weight per 100 parts by weight of the resin forming the dye-receiving layer. Too small an amount makes it difficult to obtain the desired effect, whereas too large an amount incurs considerable expense.

The thus formed dye-receiving layer may have any desired thickness, but is generally 1 to 50 μm in thickness. Such a dye-receiving layer should preferably be in a continuous film form, but may be formed into a discontinuous film with the use of a resin emulsion or dispersion.

Basically constructed as mentioned above, the heat transfer image-receiving sheet according to this invention may serve well as such. The dye-receiving layer of this invention should preferably contain a release agent so as to impart satisfactory releasability to the associated heat transfer sheet.

Preferable release agents may include silicone oils, phosphate surface active agents, fluoric surface active agents and so on. However, particular preference is given to silicone oils which are modified by epoxy, alkyl, amino, carboxyl, alcohol, fluorine, alkylaralkyl polyether, polyether, etc.

The release agents may be used alone or in combination of two or more. Preferably, they should be used in an amount of 0.5–30 parts by weight per 100 parts by weight of the resin forming the dye-receiving layer. In an amount less than the lower limit, problems such as the fusion of a heat transfer sheet to the dye-receiving layer and a drop of printing sensitivity may arise. Upon being added to the dye-receiving layer, such a release agent bleeds through it to form a release layer.

By appropriate choice of substrate sheets, the image-receiving sheets of this invention may find use in various fields including heat transfer-recordable image-receiving sheets or cards and sheets for forming a transmission type of manuscripts.

In the case of the image-receiving sheet of this invention, a cushioning layer may be additionally interposed between the substrate sheet and the dye-receiving layer, if required, thereby making it possible to reduce noise at the time of printing and transfer and record on the dye-receiving layer an image corresponding to image-wise information with good reproducibility.

The cushioning layer may be made of such materials as polyurethane resin, acrylic resin, polyethylene resins, butadiene rubber and epoxy resin, and may have a thickness in the range of about 2–20 μm.

The substrate sheet may also be provided with a slip layer on its backside, which is made of such materials as methacrylate resin, e.g. methyl methacrylate or its corresponding acrylate resin and vinylic resins, e.g. a copolymer of vinyl chloride with vinyl acetate.

Moreover, the image-receiving sheet may be provided with a detection mark. The detection mark is very useful for the alignment of heat transfer sheets with image-receiving sheets and for other purposes. For instance, a detection mark sensible by a phototube device may be printed or otherwise provided on the backside of a substrate sheet, by way of example.

The heat transfer sheet used for heat transfer to be carried out with the heat transfer image-receiving sheet of this invention includes paper or a polyester film on which a sublimable dye-containing layer is provided. For this invention, conventional known heat transfer sheets may all be used as such.

As heat energy applying means at the time of heat transfer, conventional applicator means hitherto known in the art may all be used. For instance, the desired object is successfully achievable by the application of a heat energy of about 5 to 100 mJ/mm$^2$ for a controlled recording time with such recording hardware as a thermal printer (e.g. Video Printer VY-100 made by Hitachi, Ltd.).

According to the present invention as herein mentioned, a heat transfer image-receiving sheet designed to be used with heat transfer systems making use of sublimable dyes to make clearer image representations which are of sufficient density, and show more improved fastness properties, especially more improved light fastness is provided by incorporating the specific antioxidant(s) in the dye-receiving layer thereof.

The present invention will now be explained more illustratively but not exclusively with reference to examples and comparative examples wherein, unless otherwise stated, the "parts" and "%" are given by weight.

EXAMPLE A1

With a bar coater, a 150-μm thick synthetic paper (Yupo-FRG-150 made by Oji Yuka K. K.) as a substrate sheet was coated on one surface with a coating solution composed of the following components to a dry coverage of 10.0 g/m$^2$. Following pre-drying with a dryer, 30-minute drying in an oven of 100° C. gave a heat transfer image-receiving sheet according to this invention.

| Composition of coating solution | |
|---|---|
| Polyester (Vylon 600 made by Toyobo Co., Ltd.) | 5.4 parts |
| Vinyl chloride/vinyl acetate copolymer (#1000A made by Denki Kagaku Kogyo K.K.) | 8.0 |
| Amino-modified silicone (KF-393 made by The Shin-Etsu Chemical Co., Ltd.) | 0.25 |
| Epoxy-modified silicone (X-22-343 made by The Shin-Etsu Chemical Co., Ltd.) | 0.25 |
| Antioxidant (Sumilizer TNP made by Sumitomo Chemical Co., Ltd.) | 1.3 |
| Methyl ethyl ketone/toluene (at a weight ratio of 1:1) | 84.8 |

EXAMPLE A2

The procedure of Ex. A1 was followed with the exception that 1.3 parts of an antioxidant—Sumilizer TPP-R made by Sumitomo Chemical Co., Ltd.—were used in place of Sumilizer TNP, thereby obtaining a heat transfer image-receiving sheet according to this invention.

EXAMPLE A3

The procedure of Ex. A1 was followed with the exception that 1.3 parts of an ultraviolet absorber—Tinuvin-1130 made by Ciba Geigy AG—were used in addition to the antioxidant of Ex. A2, thereby obtaining a heat transfer image-receiving sheet according to this invention.

COMPARATIVE EXAMPLE A1

The procedure of Ex. A1 was followed with the exception that in place of the antioxidant of Ex. a1, 1.3 parts of an usual hindered phenolic antioxidant—Irganox-1079 made by Ciba Geigy AG—and 1.3 parts of an ultraviolet absorber based on benzotriazole—Tinuvin-328 made by Ciba Geigy AG—were used, thereby obtaining a comparative heat transfer image-receiving sheet.

Apart from these heat transfer image-receiving sheets, a dye layer forming ink composition was prepared. This composition was then coated on one side of a 6-μm thick polyethylene terephthalate film subjected to a heat-resistant treatment on the other side or backside to a dry coverage of 1.0 g/m² by means of a wire bar coater, followed by drying. Subsequently, some droplets of silicone oil—X-41.4003A made by Shinetsu Silicone K. K.—were added to that backside and spread all over the surface for backside coating, thereby obtaining a heat transfer sheet.

| Ink composition | |
|---|---|
| Disperse dye (Kayaset Blue 714 made by Nippon Kayaku K.K.) | 4.0 parts |
| Ethylhydroxycellulose (made by Hercules Co., Ltd.) | 5.0 |
| Methyl ethyl ketone/toluene (at a weight ratio of 1:1) | 80.0 |
| Dioxane | 10.0 |

The heat transfer sheet was overlaid on each of the heat transfer image-receiving sheets of Examples A1–3 and Comparative Example A1, while the dye layer of the former was opposite to the dye-receiving layer of the latter. Then, a cyan image was formed with a thermal head at an output of 1 W/dot, a pulse width of 0.3–0.45 msec. and a dot density of 3 dots/mm. According to JIS L 0842, the cyan image was subjected to a 3.5-hour light fastness test. The results are reported in Table 2.

TABLE 1

| Image | Fading Rate (%) |
|---|---|
| Ex. A1 | 10.0 |
| Ex. A2 | 8.0 |
| Ex. A3 | 4.0 |
| Comp. Ex. A1 | 35.0 |

EXAMPLE B1

With a bar coater, a 150-μm thick synthetic paper (Yupo-FRG-150 made by Oji Yuka K. K.) as a substrate sheet was coated on one surface with a coating solution composed of the following components to a dry coverage of 10.0 g/m². Following pre-drying with a dryer, 30-minute drying in an oven of 100° C. gave a heat transfer image-receiving sheet according to this invention.

| Composition of coating solution | |
|---|---|
| Polyester (Vylon 600 made by Toyobo Co., Ltd.) | 5.4 parts |
| Vinyl chloride/vinyl acetate copolymer (#1000A made by Denki Kagaku Kogyo K.K.) | 8.0 |
| Amino-modified silicone (KF-393 made by The Shin-Etsu Chemical Co., Ltd.) | 0.25 |
| Epoxy-modified silicone (X-22-343 made by The Shin-Etsu Chemical Co., Ltd.) | 0.25 |
| Antioxidant (Sumilizer TPL-R made by Sumitomo Chemical Co., Ltd.) | 1.3 |
| Methyl ethyl ketone/toluene (at a weight ratio of 1:1) | 84.8 |

EXAMPLE B2

The procedure of Ex. B1 was followed with the exception that 1.3 parts of an antioxidant—Sumilizer TRS made by Sumitomo Chemical Co., Ltd.—were used in place of Sumilizer TPL-R, thereby obtaining a heat transfer image-receiving sheet according to this invention.

EXAMPLE B3

The procedure of Ex. B1 was followed with the exception that 1.3 parts of an ultraviolet absorber—Tinuvin-1130 made by Ciba Geigy AG—were used in addition to the antioxidant of Ex. B2, thereby obtaining a heat transfer image-receiving sheet according to this invention.

COMPARATIVE EXAMPLE B1

The procedure of Ex. B1 was followed with the exception that in place of the antioxidant of Ex. B1, 1.3 parts of an usual hindered phenolic antioxidant—Irganox-1079 made by Ciba Geigy AG—and 1.3 parts of an ultraviolet absorber based on benzotriazole—Tinuvin-328 made by Ciba Geigy AG—were used, thereby obtaining a comparative heat transfer image-receiving sheet.

Apart from these heat transfer image-receiving sheets, a dye layer forming ink composition was prepared. This composition was then coated on one side of a 6-μm thick polyethylene terephthalate film subjected to a heat-resistant treatment on the other side or backside to a dry coverage of 1.0 g/m² by means of a wire bar coater, followed by drying. Subsequently, some droplets of silicone oil—X-41.4003A made by Shinetsu Silicone K. K.—were added to that backside and spread all over the surface for backside coating, thereby obtaining a heat transfer sheet.

| Ink composition | |
|---|---|
| Disperse dye (Kayaset Blue 714 made by Nippon Kayaku K.K.) | 4.0 parts |
| Ethylhydroxycellulose (made by Hercules Co., Ltd.) | 5.0 |
| Methyl ethyl ketone/toluene (at a weight ratio of 1:1) | 80.0 |
| Dioxane | 10.0 |

The heat transfer sheet was overlaid on each of the heat transfer image-receiving sheets of Examples B1–3 and Comparative Example B1, while the dye layer of the former was opposite to the dye-receiving layer of the latter. Then, a cyan image was formed with a thermal head at an output of 1 W/dot, a pulse width of 0.3–0.45 msec. and a dot density of 3 dots/mm. According to JIS L 0842, the cyan image was subjected to a 3.5-hour light fastness test. The results are reported in Table 2.

TABLE 2

| Image | Fading Rate (%) |
|---|---|
| Ex. B1 | 9.8 |
| Ex. B2 | 8.1 |
| Ex. B3 | 3.9 |
| Comp. Ex. B1 | 35.0 |

INDUSTRIAL APPLICABILITY

The heat transfer image-receiving sheets according to this invention may have wide applications in image forming techniques relying upon thermal recording systems.

What is claimed is:

1. A heat transfer image-receiving sheet comprising a substrate sheet and a dye-receiving layer formed on one, surface of said substrate sheet, said dye-receiving layer comprising a resin containing an antioxidant expressed by the following structural formula (I):

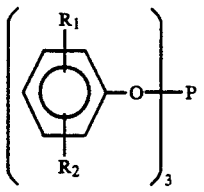

(I)

wherein $R_1$ and $R_2$ each represent a hydrogen atom or a substituted or unsubstituted alkyl group.

2. A heat transfer image-receiving sheet as claimed in claim 1, wherein the content of said antioxidant expressed formula (I) is in the range of 0.05–10 parts by weight per 100 parts by weight of a resin forming said dye-receiving layer.

3. A heat transfer image-receiving sheet as claimed in claim 1, wherein said dye-receiving layer further comprises at least one component selected from the group consisting of a light stabilizer and an ultraviolet absorber.

4. A heat transfer image-receiving sheet as claimed in claim 1, further comprising a release agent layer provided on part of the surface or over the entire surface of said dye-receiving layer.

5. A heat transfer image-receiving sheet as claimed in claim 1, further comprising a cushioning layer interposed between said substrate sheet and said dye-receiving layer.

6. A heat transfer image-receiving sheet comprising a substrate sheet and a dye-receiving layer formed on one surface of said substrate sheet, said dye-receiving layer is comprising a resin containing an antioxidant expressed by the following structural formula (II):

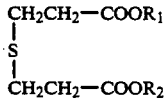

(II)

wherein $R_1$ and $R_2$ each represent a substituted or unsubstituted alkyl group.

7. A heat transfer image-receiving sheet as claimed in claim 6, wherein the content of said antioxidant expressed by formula (II) is in the range of 0.05–10 parts by weight per 100 parts by weight of a resin forming said dye-receiving layer.

8. A heat transfer image-receiving sheet as claimed in claim 6, wherein said dye-receiving layer further comprises at least one component selected from the group consisting of a light stabilizer and an ultraviolet absorber.

9. A heat transfer image-receiving sheet as claimed in claim 6, further comprising a release agent layer provided on part of the surface or over the entire surface of said dye-receiving layer.

10. A heat transfer image-receiving sheet as claimed in claim 6, further comprising a cushioning layer interposed between said substrate sheet and said dye-receiving layer.

11. A heat transfer image-receiving sheet as claimed in claim 1, wherein said dye-receiving layer further comprises at least one of a light stabilizer expressed by the following structural formula (A):

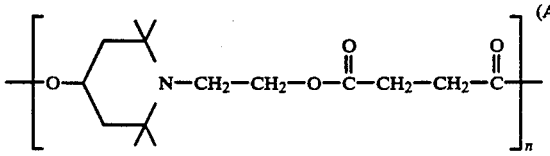

(A)

wherein n is an integer equal to or larger than 6; and an ultraviolet absorber expressed by the following structural formula (B):

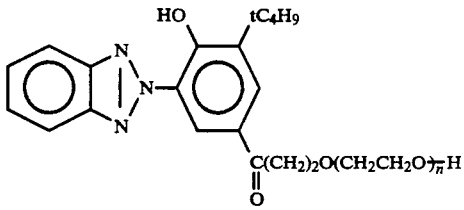

(B)

wherein n is an integer equal to or larger than 6.

12. A heat transfer image-receiving sheet as claimed in claim 6, wherein said dye-receiving layer further comprises at least one of a light stabilizer expressed by the following structural formula (A):

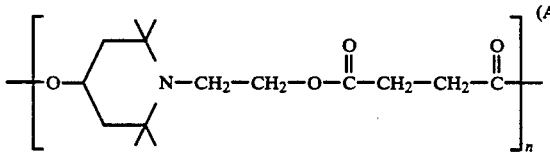

(A)

wherein n is an integer equal to or larger than 6; and an ultraviolet absorber expressed by the following structural formula (B):

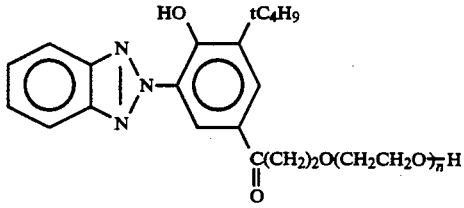

(B)

wherein n is an integer equal to or larger than 6.

* * * * *